United States Patent [19]

Urso

[11] Patent Number: 4,896,655

[45] Date of Patent: Jan. 30, 1990

[54] VERSATILE HEATER FOR UNDER-BLANKET HEATING, TENT HEATING, AND FOOD HEATING

[76] Inventor: Charles L. Urso, 215 Newton St., Waltham, Mass. 02154

[21] Appl. No.: 194,837

[22] Filed: May 17, 1988

[51] Int. Cl.[4] ..... F24C 1/16

[52] U.S. Cl. ..... 126/59; 126/93; 126/94; 126/307 R; 126/314

[58] Field of Search ..... 126/59, 4, 93, 94, 307 R, 126/314, 204, 208, 206, 85 B, 315, 262, 266, 59.5, 90 R, 248; 431/88, 200, 201, 343, 344, 345

[56] References Cited

U.S. PATENT DOCUMENTS

| | | | |
|---|---|---|---|
| 407,203 | 7/1889 | Harris et al. | 126/59 |
| 877,349 | 1/1908 | Little | 126/65 |
| 1,023,055 | 4/1912 | Wilson | 126/52.5 |
| 1,064,610 | 6/1913 | Canfield | 126/314 |
| 1,468,165 | 9/1923 | Moore | 126/59 |
| 2,567,323 | 9/1951 | Cyphert | 126/96 |
| 2,845,924 | 8/1958 | Benda | 126/208 |
| 2,904,031 | 9/1959 | Scott | 126/204 |
| 3,107,662 | 10/1963 | Genge | 126/59 |
| 3,693,610 | 9/1972 | Ehrlichmann | 126/85 B |
| 3,815,572 | 6/1974 | Wolfe | 126/59 |
| 4,241,721 | 12/1980 | Holly | 126/204 |
| 4,351,314 | 9/1982 | Morton | 126/59 |
| 4,774,931 | 10/1988 | Urso | 126/59 |

FOREIGN PATENT DOCUMENTS

| | | | |
|---|---|---|---|
| 354153 | 8/1931 | United Kingdom | 126/85 B |

*Primary Examiner*—James C. Yeung

*Attorney, Agent, or Firm*—Hamilton, Brook, Smith & Reynolds

[57] ABSTRACT

A portable heating system operable in three modes; an under-blanket heating mode, a tent heating mode, and a food heating mode. In the under-blanket heating mode, one or more users cover themselves and the basic heater (2) with a light foil-type blanket (68). Air, warmed by the heater, spreads under the blanket thereby enveloping the users so that they are comfortably warm. An adjustable canopy frame (40), in concert with a heat guard (4) enclosing a heat source (6), promotes gaseous circulation under the blanket without hazard. A thermostat (17) automatically maintains the temperature at a safe level. In a tent heating mode, the invention includes an exhaust guide for guiding combustion gases to the outside of a tent via the tent entry. Means are provided for drawing air from outside the tent into the heater for supporting combustion. Means are also provided for the system to adapt to rough or uneven terrain for high stability. In a food heating mode, the mentioned heat guard is positioned above the heat source. In this alternative position, the heat guard receives a cover (71) wherein the combination serves as an oven for heating food.

8 Claims, 8 Drawing Sheets

VERSATILE HEATER FOR UNDER-BLANKET HEATING, TENT HEATING, AND FOOD HEATING

TECHNICAL FIELD

This invention relates to portable heaters and specifically to portable heaters which utilize combustible fuels.

BACKGROUND OF THE INVENTION

Portable heaters utilizing combustible materials as fuel have long been known in the art. Need for these devices often arises in locations where household electric power is unavailable. Typical activities where such devices are needed include watching football, ice fishing, sleeping in tents, bird watching, photographing wildlife, dealing with power failure emergencies, and watching outdoor spectator events. Widespread use of such portable heaters, however, has been restricted by potential hazards which stem from the use of combustible materials.

It would be highly desirable, therefore, to provide a portable heater that can operate safely, that is simple to use, and that can be produced at low cost. Even more desirable, would be the provision of a small, simple, combination heater that could be safely used for all of the above-mentioned needs.

SUMMARY OF THE INVENTION

The invention is operable in at least three modes; an underblanket heating mode, a tent heating mode, and a food heating mode.

In the under-blanket heating mode, one or more users cover themselves and the basic heater with a light foil-type blanket. Air, warmed by the heater, spreads under the blanket thereby enveloping the users so that they are comfortably warm while bird watching, fishing, camping, studying wildlife, or watching a football game. By eliminating the need for multiple layers of clothing, the users can pursue their outdoor activities in greater comfort. An adjustable canopy frame, in concert with a heat guard enclosing a heat source, promotes gaseous circulation under the blanket without hazard. A thermostat automatically maintains the temperature at a safe level.

In a tent heating mode, the invention includes an exhaust guide for guiding combustion gases to the outside of a tent via the tent entry. Means are provided for drawing air from outside the tent into the heater for supporting combustion. The mentioned safety devices for under-blanket operation also operate in the tent if the heater is inadvertently covered with a blanket or sleeping bag. Means are also provided for the system to adapt to rough or uneven terrain for high stability. The invention adapts to any tent without altering the latter.

In a food heating mode, the mentioned heat guard is positioned above the heat source. In this alternative position, the hollow heat guard receives a cover wherein the combination serves as an oven for heating food.

Important advantages of the system are safety, easy operation, and versatility in switching from one operating mode to another. Other objects and advantages of the invention will become apparent from consideration of the drawings and ensuing description.

BRIEF DESCRIPTION OF THE DRAWINGS

The accompanying drawings in combination with the description herewith, illustrate features and advantages of the invention. Like reference characters in different views refer to the same parts. The drawings are intended to illustrate principles of the invention and are not necessarily to scale and in which drawings.

DESCRIPTION OF A FIRST EMBODIMENT OF THE INVENTION

Figure 1:
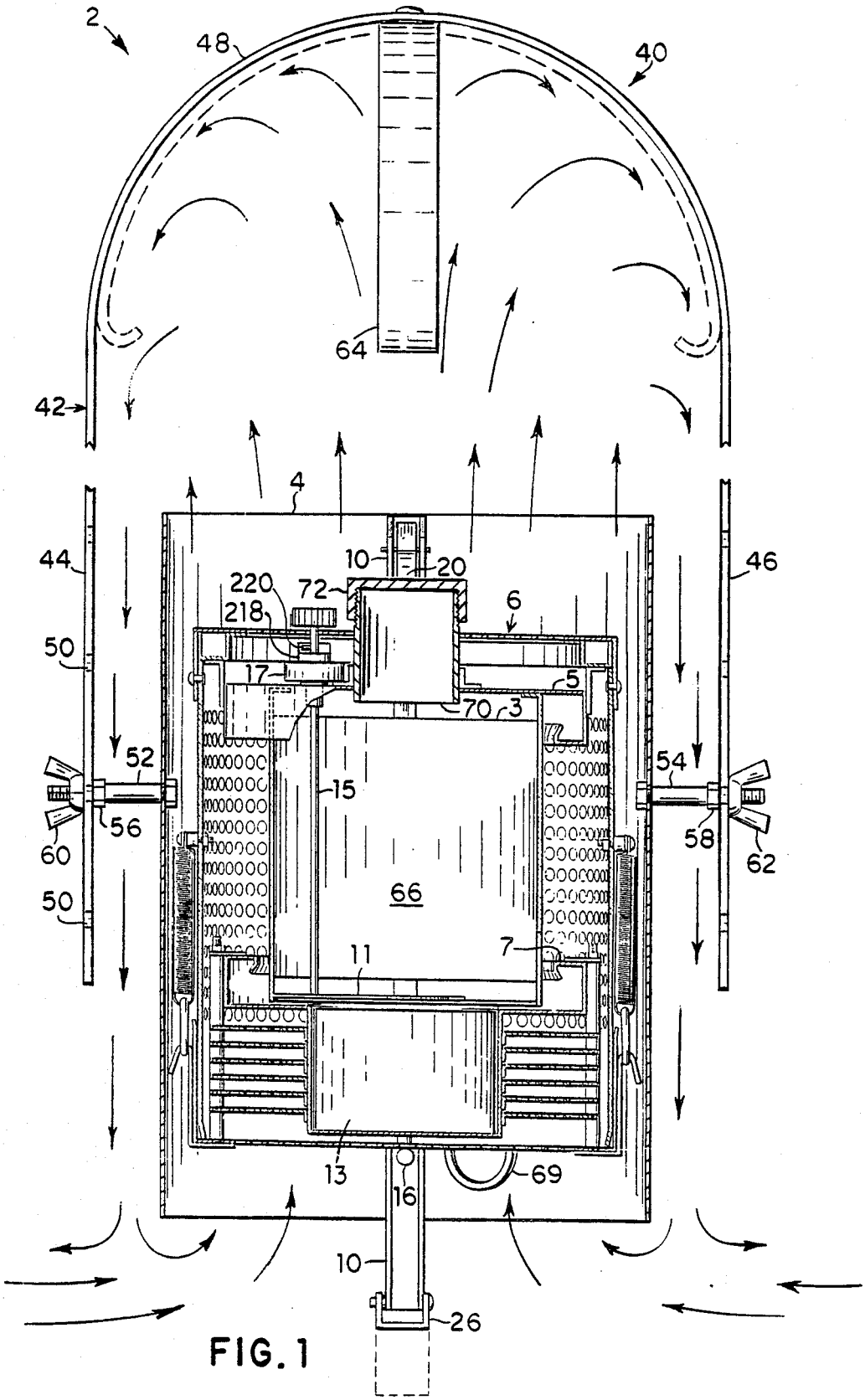
FIG. 1 is a cross-sectional view of a first embodiment of the shielded heater taken along the longitudinal centerline.

The subject invention is a system comprising a shielded heater 2 (FIG. 1) and attachable accessories which are described hereinafter. Heater 2 includes a heat guard 4 which is a hollow cylinder positioned so that its cylindrical axis is normally vertical. The lower and upper ends of the cylinder are open so that atmospheric air can freely pass through. A section of conventional heavy gauge stovepipe can serve as an economical heat guard.

Enclosed within the heat guard 4 is a heat source. Although a backpack stove or other small heater could serve as a heat source, a preferred source is a safety heater 6 having U.S. Pat. No. 4,691,688 issued to this inventor. Air enters, and combustion gases exit, a combustion chamber 66 but liquid and other portions of the heater's semisolid fuel are prevented from escaping if the heater is upset. This is accomplished by forming the combustion chamber from a hollow cylinder 3 and enclosing the end portions of the same with specially designed caps 7 and 5. The caps include fuel entrapping conduits which define the entry and exit passages for air and combustion gases. The combination is designed to catch liquid or semi-solid fuel before the material can exit a passage. The fuel entrapping feature operates in all positions of the heater so that if the same should tip over or fall into any abnormal position, fuel is prevented from leaking out. Hence, fire is avoided.

Important advantages of semisolid fuel is that it is much safer to handle and use than flammable liquids or compressed flammable gases. This is especially important in crowded stadiums and in camping tents where this invention is used. Clean burning semisolid fuels are commercially available in cans produced in at least two different sizes.

Figure 2:
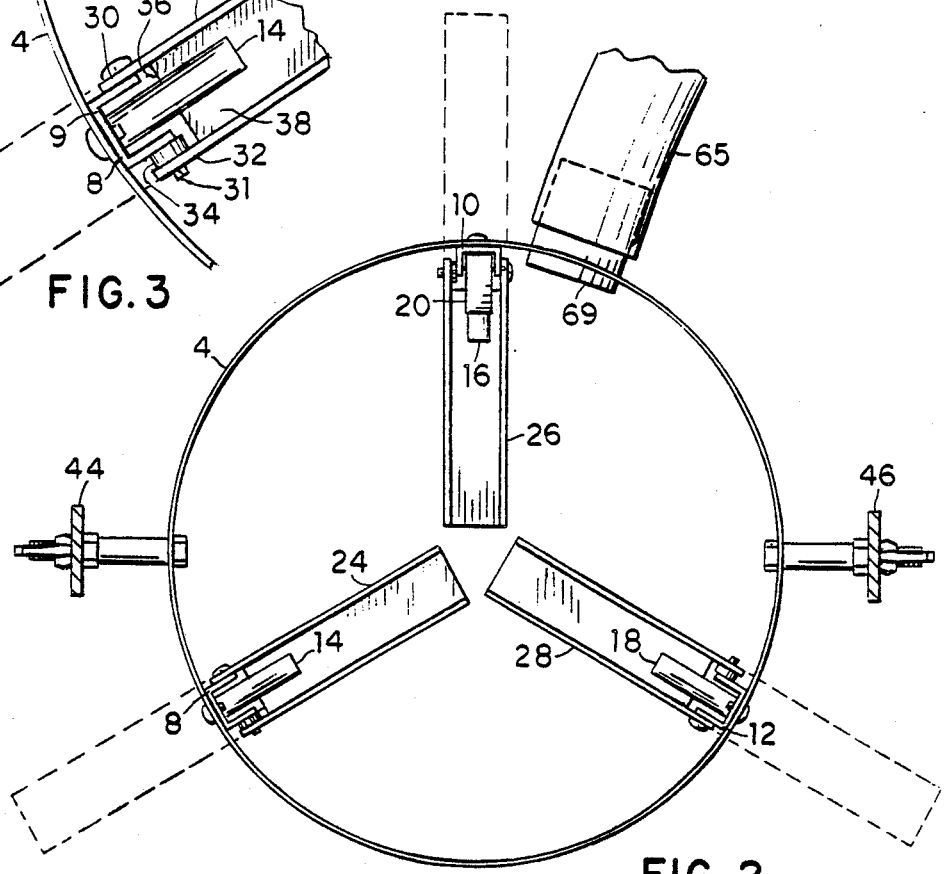
FIG. 2 is a plan view of the heater of FIG. 1 wherein the heat source is removed and an upper portion of the canopy frame is broken away.

The heat source 6 is held in a coaxial position within the heat guard 4 and is spaced from the cylinder wall by three channels 8, 10, and 12 (FIG. 1 and 2). Each channel is fastened in a vertical position to the inner surface of the heat guard wall with rivets. The channels are equally spaced from each other and the open side of their U-shaped cross section faces toward the central axis of the heat guard. Thus, the channels form tracks on which the heat source moves when being inserted or removed. The upper end portion of each channel is cut at a 45 degree angle sloping downward mesially of the heat guard. The sloped ends of the channels serve to guide the heat source 6 into a coaxial position within the heat guard 4 when the heat source is inserted therein.

Figure 3:
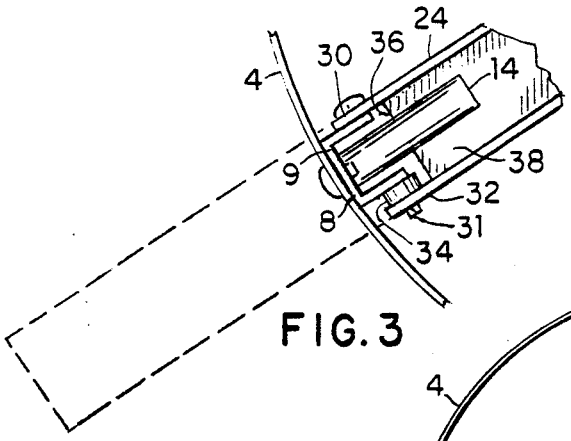
FIG. 3 is an enlarged fragmentary view showing a support post and an upper and lower tripod leg.

In order to support the heat source 6 within the heat guard 4, three support posts 14, 16 and 18 are fixedly attached to lower end portions of the channels, respectively. Each post extends radially inward from the base wall 9 (FIG. 3) of a respective channel. Each post is attached by means of a screw passing through the heat guard wall and channel to a threaded bore (not shown) within the post.

In order to hold the heat source within the heat guard in the event that the device is upset, a stop lever 20 is pivotally supported within an upper portion of channel 10. Pivotal support for the lever 20 is provided by a pin passing through the lever and through the sides of the channel. The lever is movable between a retracted position (wherein the entire lever is within the channel) and a stop position (wherein a top end of the lever contacts the base wall of the channel and a lower portion of the lever protrudes out of the channel as shown in FIG. 2). In the stop position, the lever lower portion impedes and thereby prevents the heat source 6 from coming out of the heat guard 4. A small torsion spring (not shown) is arranged to urge the lever toward the stop position. Thus, the heat source 6 can be inserted downwardly into the heat guard (after refueling, for example) wherein the lever is deflected into the channel. However, in order to remove the heat source 6 from the heat guard 4, the operator must first press down on the protruding lever 20 while lifting the heat source. The lower portion of the lever is rounded to prevent the same from catching in holes in the side of the heat source 6 as the latter is lifted out of the heat guard.

Heat guard 4 is supported on a tripod having retractable lower legs 24, 26 and 28. The legs comprise channels having a larger width than the vertical channels described above which form upper legs of the tripod. A portion of the lower leg base wall 38 (FIG. 3) is removed from an end portion of each leg so that the remaining side walls form a pair of tines 30 and 32. The tines provide a means for pivotally attaching each lower leg to a respective upper leg by positioning the latter between the tine pair and passing a rivet 31 through the tines and upper leg.

The rivet also passes through a rubber washer 34 compressed between a tine and upper leg. The friction, caused by a rubber washer associated with each lower leg, provides a means for holding the lower legs in a retracted position as shown by the solid line representation of the legs in FIG. 1, 2, and 3.

The tripod lower legs are movable between the retracted position and an extended position (shown by the broken line representation in the three mentioned figures). The extended position is limited by an edge 36 (defined by the remaining portion of the channel base wall 38 of a lower leg) as the edge contacts the base wall 9 of a vertical channel 8 (upper leg). This occurs when a lower leg is at an angle of about twenty five degrees to the surface on which the tripod rests.

In cramped or crowded conditions, the heater can rest with the tripod legs retracted.

Note that for economy the described channel members, including the upper and lower tripod legs, can be cut from standard aluminum channel stock.

In an alternative arrangement, a set of lower legs (not shown) of a tripod could be attached to the upper legs by hinges such that the retracted lower legs are vertically positioned against the outside surface of the heat guard. That would allow the use of longer legs for a larger tripod, if preferred.

Straddling the heat guard 4 is a canopy frame 40 (FIG. 1) comprising a U-shaped handle 42 having two legs 44, 46 and a fixed rib 48 spanning from one leg to the other leg. Each handle leg includes a vertical column of equally spaced holes 50 piercing therethrough. The holes of one handle leg are horizontally aligned with diametrically opposing holes of the other handle leg.

The handle 42 is supported on a pair of bolts 52, 54, received in a selected pair of opposing holes 50. Each bolt 52, 54 extends through an aperture in the heat guard wall so that the bolt head is in contact with the inside of the wall and is welded thereat. The shaft of each bolt extends in a radially opposite direction from that of the other bolt so that the pair are axially aligned.

Each leg 44, 46 of the handle rests against a stationary nut 56, 58 fixed approximately midway on each bolt, respectfully. A wing nut 60, 62 mated to each bolt holds each respective handle leg thereon.

The canopy frame 40 further comprises a movable rib 64 pivotally supported under the fixed rib 48 by a rivet passing through a midpoint of each rib. The rivet also passes through a rubber washer (not shown) compressed between the ribs. Friction caused by the washer holds the rib 64 until deliberately moved by a user, rather than allowing the rib to pivot freely.

Rib 64 is movable between a deployed position (solid line representation across the fixed fib in FIG. 1) and a retracted position (broken line representation). In the deployed position the movable rib broadens support at the flanks of the fixed rib for a heat entrapping canopy formed when a blanket is placed over the heater 2. The function of the canopy is explained hereinafter.

Both ribs are arcuate so that when the movable rib is in the retracted position, the latter aligns and conforms with the fixed rib. Thus, the combination forms a convenient carrying handle for the shielded heater 2. It is understood that straight rather than arcuate ribs could be substituted.

When the heater requires refueling, the wing nuts 60, 62 are loosened so that the frame 40 can pivot on the bolts 52, 54. The frame is then moved from its normal erect position to an inclined position. In the latter position, the frame is angled by an amount sufficient to clear the way for the heat source 6 to be lifted out of the heat guard 4 to be refueled and then replaced.

By removing the wing nuts, the handle legs 44, 46 can be spread apart slightly and taken off the bolts 52, 54. The bolts can then be received through a different pair of holes 50 so that the canopy frame 40 can be selectively adjusted up or down relative to the heat guard 4.

During portage or storage, the heater 2 is normally reduced to a compact size by placing the canopy frame 40 at its lowest position and placing the movable rib 64 at its retracted position.

Figure 4:
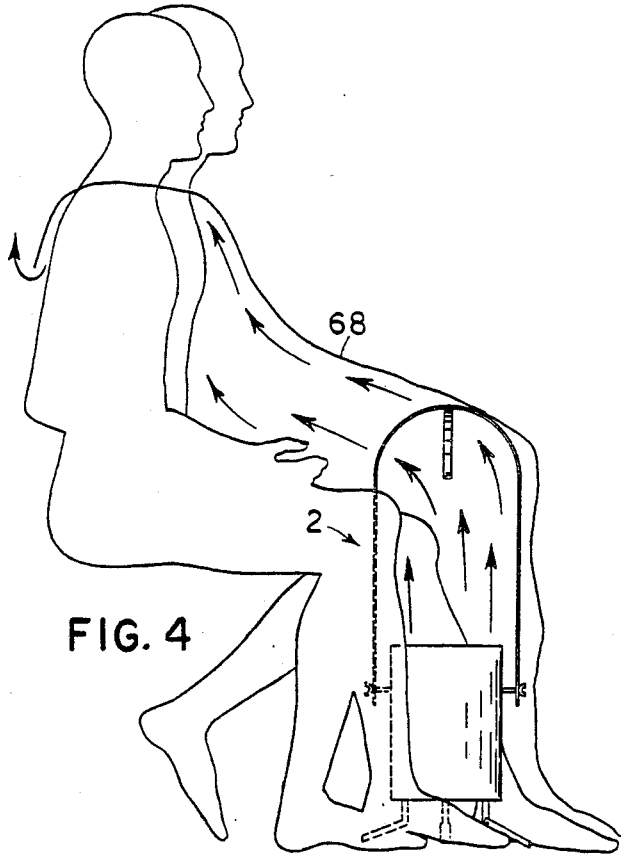
FIG. 4 is a diagrammatic view of the operating shielded heater positioned between two seated users wherein the heater and users are covered by a blanket.

When the heater 2 is to be used in an under-blanket heating mode, the canopy frame is raised to an upper position (FIG. 4) and the movable rib is placed in the deployed position.

The above described canopy frame can be economically constructed from standard aluminum bar stock, cut and rolled into the described shapes.

Under-Blanket Heating Mode

One of the valuable uses of heater 2 is that one or more people can keep warm in cold weather by placing a light blanket 68 (FIG. 4) over themselves and the operating heater. The blanket forms a canopy over the frame thereby entrapping and spreading warm air rising from the heater so that the heated air envelops the users. The two people in FIG. 4 could be seated in the bleachers of a football stadium, or bird watching, fishing, camping, or photographing wildlife activities. Note that the canopy frame is adjusted to a position above the knees of the users. This provides space for the rising warm air (indicated by the arrows) to envelope most of their bodies for maximum comfort. The heads of the users are kept above the blanket.

The arcuate shape of the upper portion of the frame allows the blanket 68 to easily slide over the heater without getting caught or entangled. The end portions of the movable rib are bent inwardly to avoid catching in the blanket.

A preferred blanket is the thin outdoor type which usually comprises a layer of reflective aluminum foil for reflecting heat energy toward the user. One or more layers of reinforcing material is usually attached to the foil to result in a thin, light, wind and water proof protector. Such blankets can be folded to a very small size. Some are pocket-sized when folded.

Another advantage of the described outdoor blankets is that they are somewhat stiffer than woven blankets so that the former don't cling or hang limp on the heater frame. Hence, there are more spaces for air circulation.

Air to support combustion is supplied by infiltration through numerous tunnels formed under folds, wrinkles, creases, and undulations in the blanket. Exhaust gases escape through similar routes.

In the event that a blanket is left unattended over the heater, a route for the gases to circulate is indicated by the arrows in FIG. 1 (the blanket is not shown). When the rising warm gases meet the relatively cool foil of the blanket, heat is transferred. As the gases cool, they sink down into the lateral space (between the guard and the blanket) surrounding the heat guard 4. The gases can then move out through the mentioned infiltration tunnels under the blanket, or recirculate through the heat guard 4. The canopy frame is spaced from the heat guard in order to insure these circulation routes. This helps to prevent excessively hot spots from developing under the blanket.

The heat source 6 includes a flame attenuator 11 comprising a plate which slides over the opening of a fuel can 13. The plate is fixed to a rotatably mounted shaft 1. Thus, by pivoting the shaft, the flame emanating from the can is adjusted or extinguished.

In FIG. 1, the heat source 6 includes a thermostat comprising a bimetallic coil 17 encircling a sleeve 218 rotatably supported on shaft 15. An inner end f the coil is attached to the sleeve while an outer end of the coil is attached to the upper cap 5. An upper portion of sleeve 218 includes a 180 degree void. Within the void is a pin 220 having an end portion press fitted in a transverse bore in shaft 15. The combination is arranged such that the sleeve can rotatably slip 180 degrees about shaft 15. The slip limit is reached when the sleeve edges, which define the void, engage the pin. Coil 17 is set such that during normal operating temperature of the heater, the sleeve movement caused by the coil does not exceed the slip range. But if the temperature exceeds a predetermined level, the coil rotates the sleeve beyond the slip limit thereby pivoting the shaft 15 which adjusts the flame size. A torsion spring (not shown) connected to the shaft urges the same back to its original position. Hence, the heat is automatically controlled in a feedback system for safe under-blanket operation.

An additional modification of the heat source 6 is the addition of a pipe nipple 70 fixedly received in an aperture through the upper cap 5. When the heater is operated in an underblanket mode, the nipple is tightly capped by a fluid tight cap 72. The pipe nipple 70 is for use in other operating modes of the shielded heater 2 described hereinafter.

Tent Heating Mode

Figure 5:
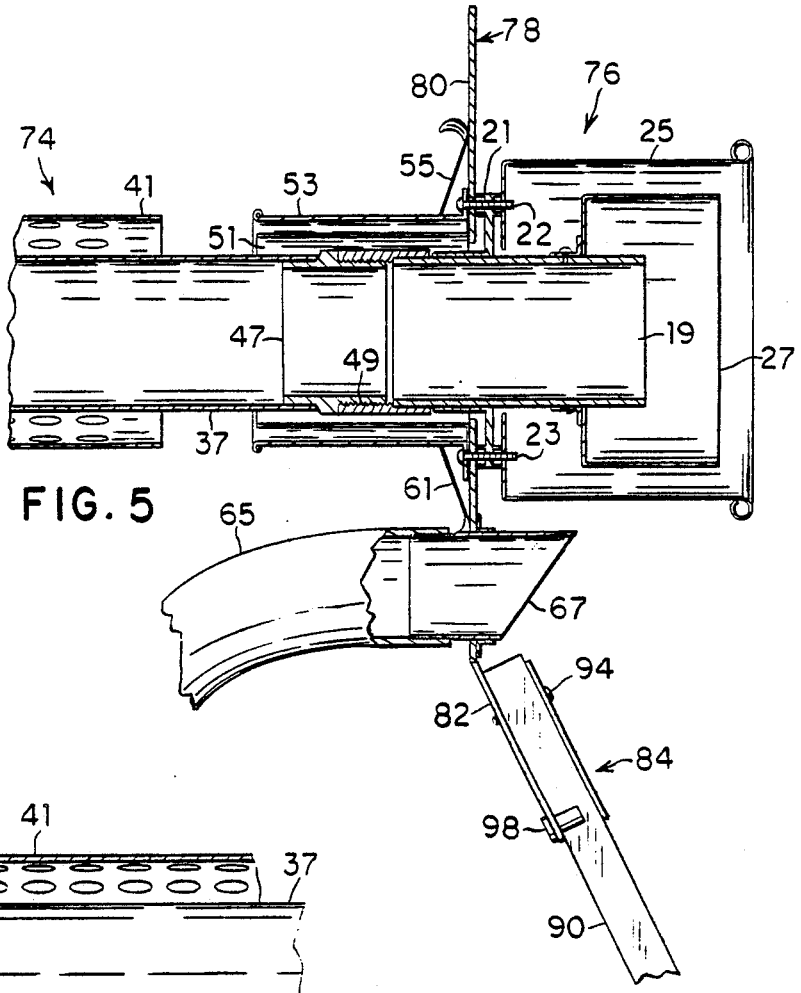
FIG. 5 is a fragmentary cross-sectional view taken along the longitudinal centerline of the exhaust tube assembly connected to the bipod assembly.
Figure 6:
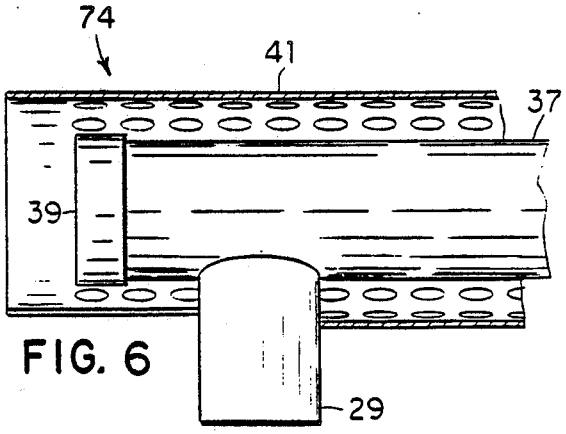
FIG. 6 is a fragmentary cross-sectional view taken along the longitudinal centerline of the exhaust tube assembly.
Figure 8:
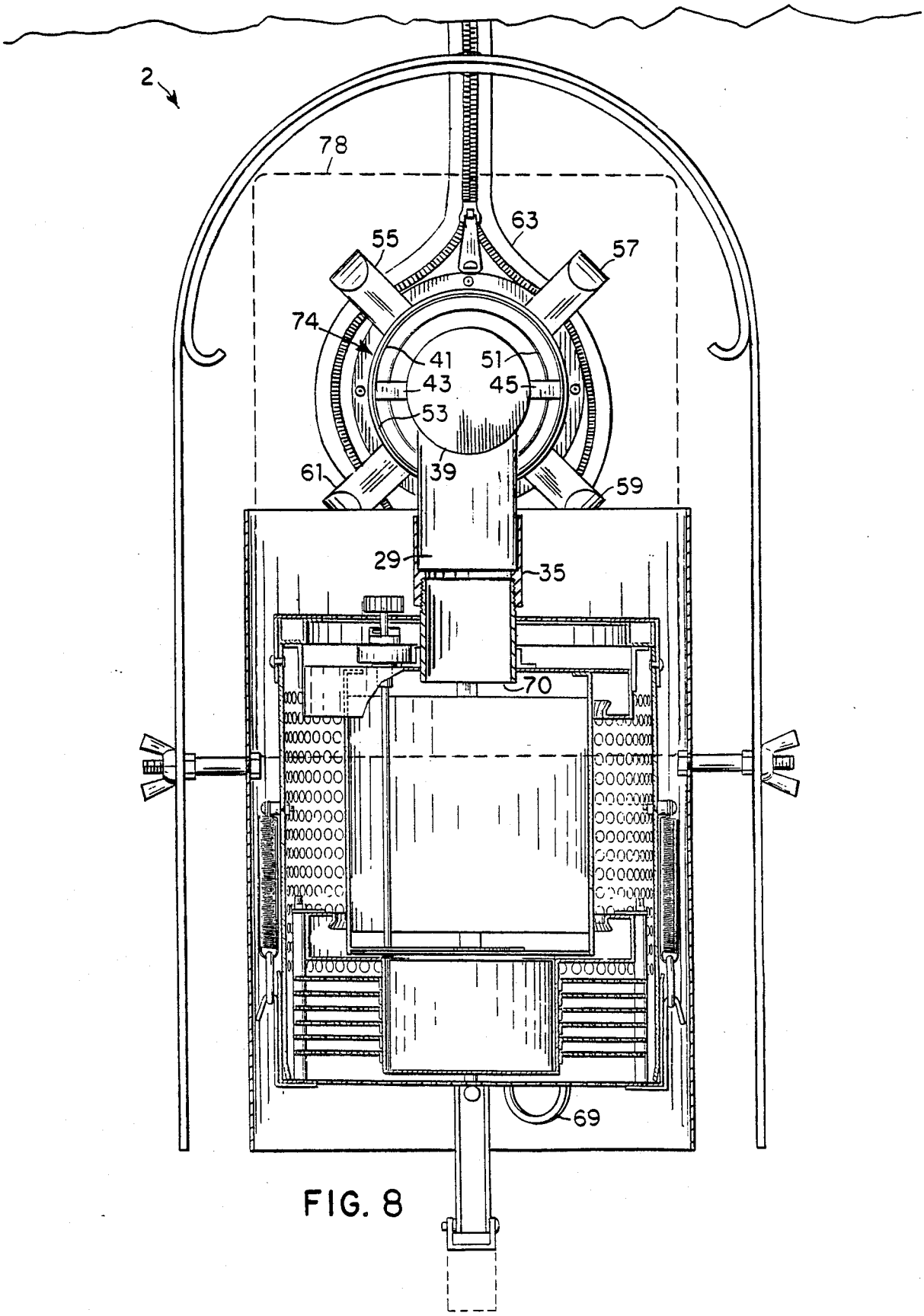
FIG. 8 is a cross-sectional view taken along the longitudinal centerline of the shielded heater of FIG. 1 connected to the exhaust tube and bipod assemblies and showing a tent entry zipper held against the weather flange by the zipper clips.

By removing cap 72 and connecting an exhaust guide to the heater 2, the combination can be used for safely heating a tent. Combustion gases are guided by the system to the outside of the tent. The exhaust guide comprises the gas guiding tubes 29, 37 and 19 (FIG. 5, 6 and 8). The tubes are housed within an exhaust tube assembly 74 detachably connected to a bipod assembly 76.

The exhaust tube assembly 74 includes the ascending tube 29 (FIG. 6 and 8) which connects to pipe nipple 70 by a connector 35. Tube 29 simply slides into the connector. An upper portion of tube 29 is received in an aperture in the transverse tube 37 wherein the former is welded to the latter. A rear end of transverse tube 37 is sealed with a cap 39. Tube 37 is enclosed by a perforated tube 41 so that the former is heat shielded. Tube 41 is supported by brackets 43 and 45 (FIG. 8). A front end of the transverse tube 37 is fixed to an externally threaded male connector 47 (FIG. 5) which completes the exhaust tube assembly.

The exhaust tube assembly 74 detachably connects to the bipod assembly 76 by screwing into an internally threaded female connector 49 which is fixed to distal tube 19 Bipod assembly 76 also includes a weather flange 78 comprising a rectangular aluminum plate having an upper portion 80 and a lower portion 82. The lower portion is bent forwardly at a small angle relative to the upper portion. A central aperture in the upper portion of the weather flange allows the distal tube 19 to pass through. The tube 19 is supported by an annular flange 21 which is held to the flange 78 with screws 22 and 23. The screws pass through a peripheral portion of flange 21 which is expanded in a direction parallel to tube 19.

Enclosing the connectors 47 and 49 is an intermediate tube 51 having a flared end portion. The flared portion forms a flange seated against a rear face of weather flange 78. The intermediate tube 51 is enclosed by an outer tube 53. An end portion of the outer tube is flared to form a flange seated against the intermediate tube flange. Both tube flanges are held to flange 78 by screws 22 and 23. Tube 51 serves to shield tube 53 from the heat of tubes 37 and 19. Thus, outer tube 53 remains relatively cool during operation of the heater 2.

Riveted to the outer surface of tube 53 are spring steel. zipper clips 55, 57, 59, and 61 (FIG. 5 and 8). The clips are yieldingly urged against the rear face of flange 78. Their function is to hold the tent entry zipper 63 (FIG. 8) against the weather flange 78 to seal out the weather while combustion gases from heater 2 are exhausted to the outside of the tent. The flange 78, indicated by the broken line of FIG. 8, is on the outside surface of the tent entry.

The expanded portion of the flange 21 also supports an outer shield cup 25 in spaced relation to flange 78 by means the mentioned screws 22, 23. A central aperture in cup 25 receives tube 19 therethrough. In this arrangement tube 19 does not contact flange 78 or cup 25 so that heat conduction to the latter two elements is inhibited.

An inner shield cup 27 includes a central aperture for receiving a front portion of tube 19 fixedly therein. Inner cup 27 serves to shield cup 25 from the heat of exhaust gases emanating from tube 19. Hence, the outer cup 25 and weather flange 78 remain cool during operation of the system.

Figure 7:
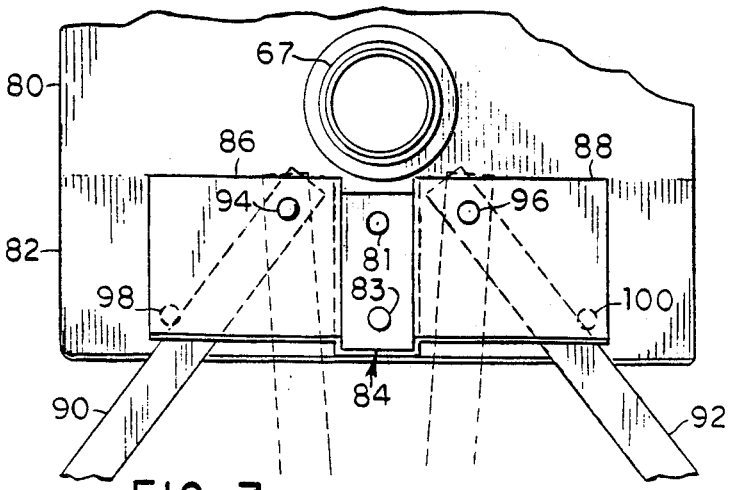
FIG. 7 is a fragmentary front view of the bipod assembly showing how the legs are pivotally supported.

Attached to the lower flange portion 82 is a leg bracket 84 (FIG. 5 and 7) fixed by rivets 81 and 83. Bracket 84 is shaped to form two symmetrical wings 86 and 88 spaced from a front surface of the flange. Pivotally supported between each wing and the flange is a bipod leg 90 and 92, respectively. Each leg pivots about a respective rivet 94 and 96. The legs are movable between a retracted position (broken line representation in FIG. 7) and a spread position (solid line representation). Posts 98 and 100, press fitted in apertures in the plate, provide a limit to the spread position.

During operation of the system, the bipod assembly 76 stands on the ground outside of the tent entry. Components positioned on the inside of the tent entry include tubes 51 and 53 and the zipper clips. The tube assembly 74 and the heater 2 are positioned inside the tent.

The system described above readily adapts to rough ground or uneven terrain. On extremely rough ground, only one leg of the tripod (of the heater 2) need be extended since in concert with the bipod assembly the combination forms a larger tripod. The high stability provided by the system on any surface prevents the combination from toppling if bumped by tent occupants as they move in their sleep.

The flue effect created by the system causes a slight negative pressure inside the tent. This speeds up the passage of atmospheric air into the tent through the normal air infiltration routes of the tent. Hence, the tent occupants and the heater are supplied with fresh air.

For extra safety, however, the system includes an air intake tube 65 connected to an outside nipple 67 (FIG. 5). The nipple 67 is fixed within an aperture through flange 78 in order to draw outside air. Intake tube 65 is a flexible neoprene hose having an opposite end connected to an inside nipple 69 (FIG. 2). The nipple 69 is fixed into an aperture through a bottom end portion of heat guard 4. The cross-sectional area of the intake tube is about one half that of the heater exhaust nipple 70. Air is drawn through tube 65 by the negative pressure resulting from the flue and by the weight of the heavier outside air.

To summarize operation in the tent heating mode, the user will first screw exhaust tube assembly 74 into the bipod assembly 76. Cap 72 of the operating heater 2 is removed and the exhaust tube assembly is connected to the nipple 70 by sliding it into connector 35. The combination is placed such that the bipod is outside the tent entry and heater 2 is inside the entry. The zipper 63 of the entry is then closed around the outer tube 53 and tucked under the clips 55, 57, 59 and 61.

Shielded as described, there are no exposed hot surfaces on the system. Thus, burnable fabrics or human skin can come in direct contact without any danger.

To refuel, the inner end of the exhaust tube assembly is simply lifted out of the connector 35 to disconnect the heater 2. The heat source can then be removed from the heat guard for refueling. The exhaust tube assembly and bipod assembly remain in place so that the tent entry zipper remains undisturbed.

Because of the numerous safety features of the system, the tent occupants are warm and safe from the hazards normally associated with conventional heaters. If the heater 2 is inadvertently covered by a blanket or sleeping bag, the protective features described for the under-blanket mode prevent fire. The system promotes adequate ventilation, as described above.

Because of the small size and light weight of the described tent mode heater, no significant time is lost in leaving the tent. The tent entry zipper can easily be pulled out of the zipper clips of the bipod assembly wherein the system can be picked up as a unit and placed where desired. Since the invention need only be about knee-high to an adult, a child could unzip the the tent zipper and remove the heater with no significant time lost. Alternatively, of course, a separate zipper could be added to the tent for use exclusively by the tent ode heater.

The tent mode heating combination reduces to three compact pieces for convenient portage or storage; the heater 2, the exhaust tube assembly and the bipod assembly. As mentioned, the heater 2 can be reduced in size by lowering the canopy frame to its minimum height and retracting the movable rib and tripod legs. The bipod assembly can also be reduced in size by retracting its two legs. If telescoping legs are used in the bipod, further size reduction would result.

Food Heating Mode

Figure 9:
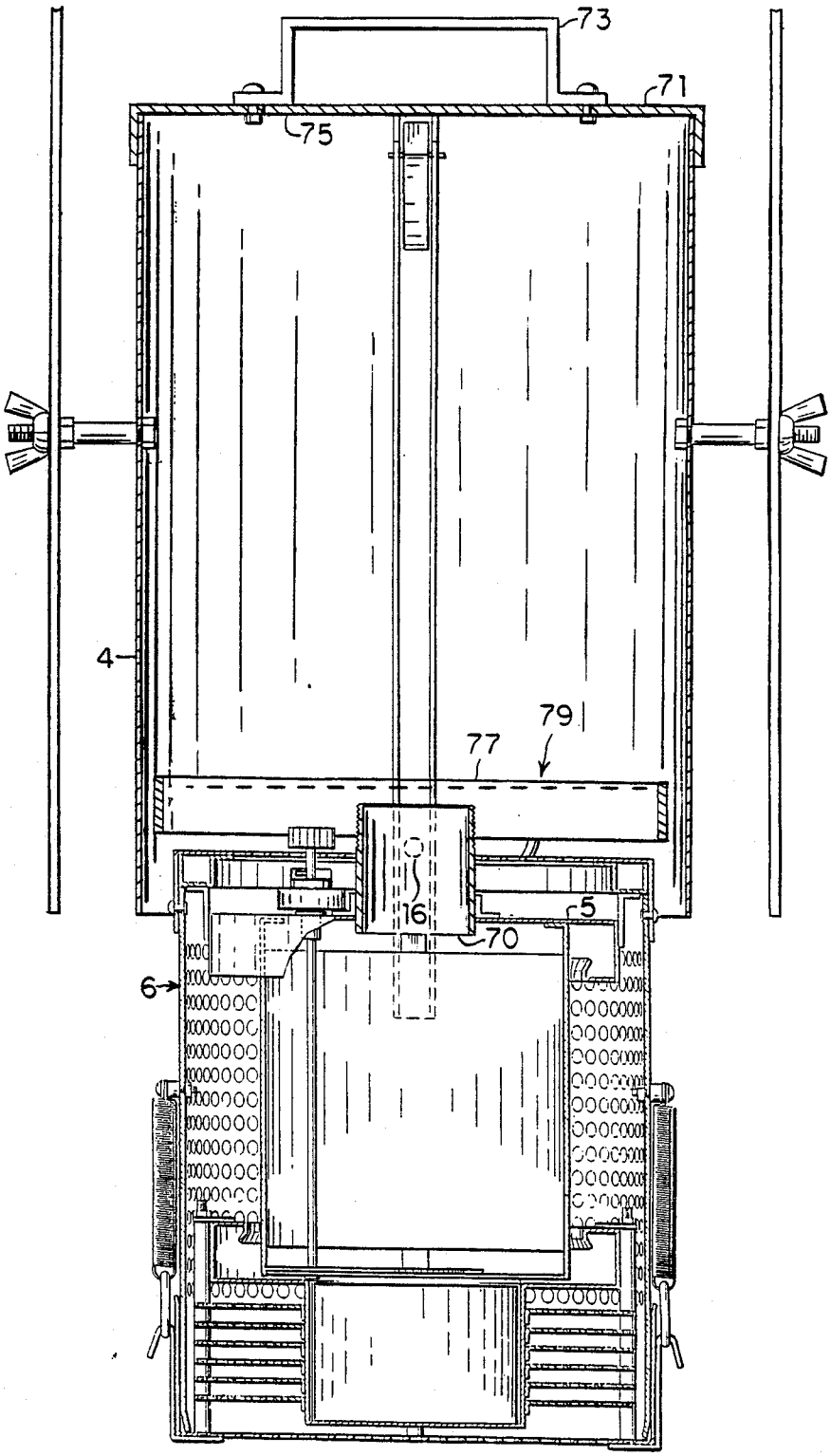
FIG. 9 is a cross-sectional view taken along the longitudinal centerline of the heater of FIG. 1 showing the heat guard repositioned to be above the heat source and having a cover so that the combination can serve as a food heater.

Heat source 6 can be removed from the heat guard 4 wherein the latter can be placed on top of the former (FIG. 9). The lower tripod legs (not shown) are in the extended position. Support posts 14, 16, 18 will then rest on top of the heat source thereby supporting the heat guard in its alternative position. Nipple cap 72 is removed so that hot air and other gases rise directly from the combustion chamber into the heat guard 4.

Hence, the hollow heat guard 4 can receive food to be heated during an outdoor activity. A cover 71 having a handle 73 can be placed over the heat guard to reduce heat loss. The bottom surface 75 of the cover is polished aluminum so as to be heat reflective. Thus, the food is heated by hot gases emanating from the nipple 70, by heat radiating from cap 5, and by heat reflected from the polished undersurface 75 of the cover 71. To prevent food crumbs from falling on the heat source a screen 79 (represented by broken line), having an annular supporting frame 77, is placed in the heat guard. The screen and its frame is supported on top of the mentioned support posts. Bread, chicken, chestnuts, potatoes, rolls, and sandwiches are example of items that can be heated.

During portage or storage, the heater 2 can be reduced to its compact configuration mentioned hereinbefore. The cover 71 can be carried in place on the heat guard. The screen and its frame could be carried inside the heat guard, just under the cover 71.

The combination in the food heating mode as shown in FIG. 9 can alternatively be used as an under-blanket heater (assuming that cap 72 is replaced for safety). In that arrangement, the heat guard 4 shields the hot (top) portion of the heat source 6 for prevention of burns. An advantage of the arrangement is that the canopy frame need not be upwardly adjusted. That is, the heat guard in its alternative or upper position places the frame at a sufficiently elevated level for safe under-blanket heating. Thus, the feature for vertical adjustment of the canopy frame could be eliminated or made optional.

The combination can be viewed as comprising a first cylinder (perforated cylinder of heat source 6) surrounding a fuel source. The heat guard 4 is viewed as a second cylinder wherein the two cylinders are coaxially slidable relative to each other.

A modification of this combination could include the addition of a retractible tripod (not shown) connected to the underside of the heat source 6 for greater stability. When inserting the heat source in the heat guard (for storage or in preparation for another operating mode), the heat source tripod would be retracted. When the heat source is fully inserted in the heat guard, the heat source tripod legs could then be extended. Hence, the addition of a heat source tripod could eliminate the need for the lower legs of the heat guard tripod.

It can therefore be understood that the invention, with or without the mentioned modification, is very versatile and could be used in all three modes during a single outdoor sporting trip.

ALTERNATIVE EMBODIMENTS

Second Embodiment

Figure 10:
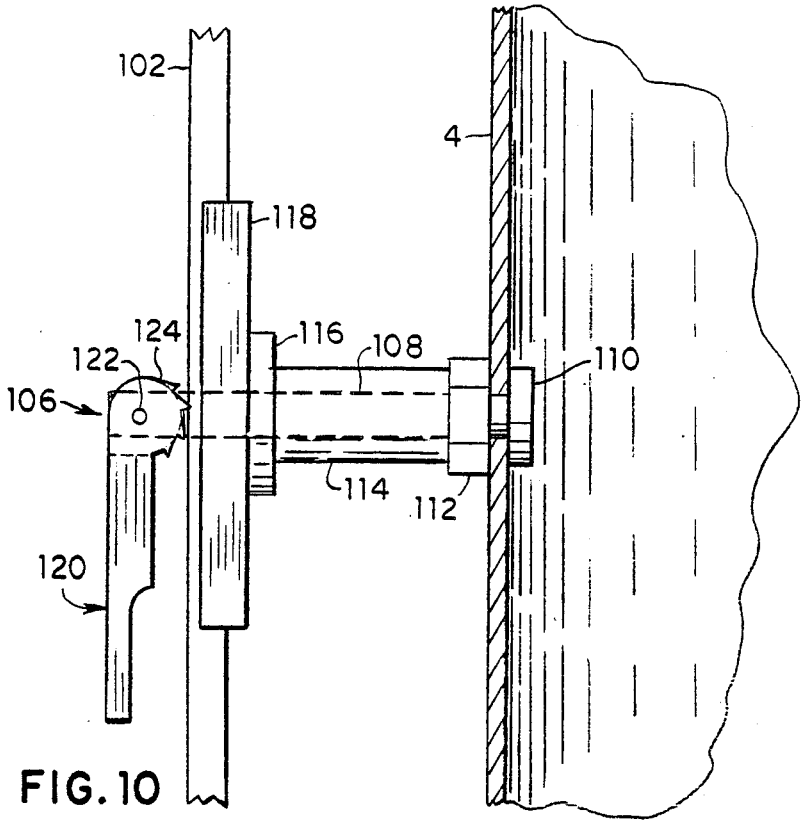
FIG. 10 is a fragmentary side view of the second embodiment of the shielded heater showing the fast-release canopy frame lock with the lever in the locked position.
Figure 11:
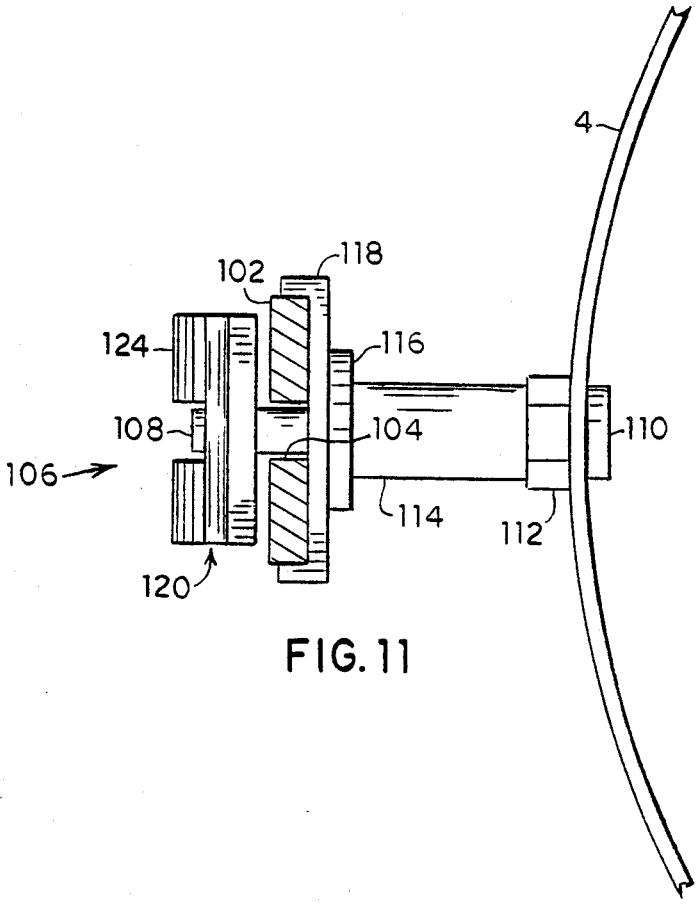
FIG. 11 is plan view of the fast-release canopy frame lock of FIG. 10 with the lever in the release position.

An alternative method of supporting and adjusting a canopy frame is shown in FIG. 10 and 11. The figures show fragmented views of the leg 102 of a canopy frame similar to that of the first embodiment. The difference in the frame is that a vertical slot 104 replaces the vertical column of holes that are used in the first embodiment for adjusting the frame. The bolt and wing nut method of supporting the leg in the first embodiment is replaced with a fast-release canopy frame lock 106 comprising a shaft 108, having a head 110, received in an aperture in eat guard 4. The shaft 108 is fixed thereat by a nut 112 mated to a threaded base portion of the shaft. Rotatably supported on the shaft is a track 118 fixedly combined with a flange portion 116 and a sleeve portion 114 so that the combination pivots about the shaft. The track has a U-shaped cross-section so as to form a bed which slidably receives the leg 102 of the canopy frame. Shaft 108 passes through slot 104 in the leg 102 so that the shaft does not impede the sliding action of the leg. Pivotally mounted on a distal end portion of the shaft 108 is a locking lever 120. The lever is supported by a pin 122 passing through the shaft and through a toothed cam 124 which forms an end portion of the lever.

The lever 120 is movable between a locked position (FIG. 10, wherein the cam teeth lock the leg 102) and a release position (FIG. 11, wherein the leg is free to slide up or down in the track and to pivot about shaft 108). Thus, by use of the fastrelease lock 106, the frame can be adjusted vertically or inclined to clear the way for removal and maintenance of the heat source. A similar locking device supports the opposite leg of the canopy frame.

An advantage of this modification is that fast pivotal and vertical adjustments can be made wherein the canopy frame does not have to be removed from its support to make a vertical adjustment. Comparatively, an advantage of the first embodiment frame adjusting method is that it is very simple and very economical.

Third Embodiment

Figure 12:
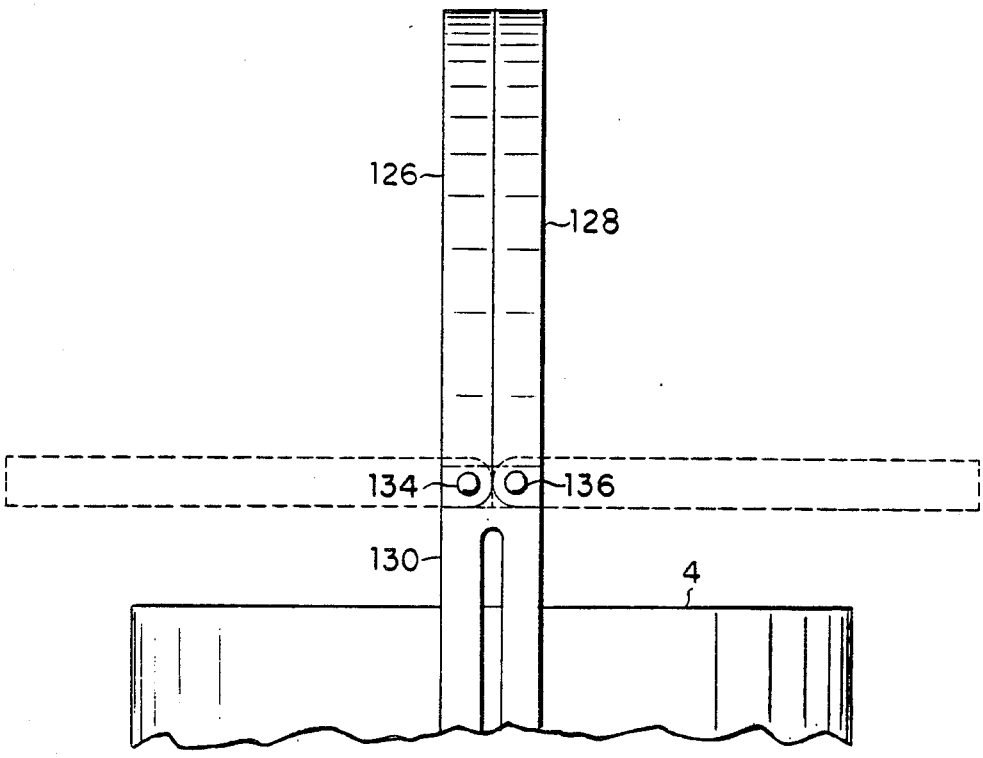
FIG. 12 is a fragmentary side elevation view of an upper portion of the third embodiment of the shielded heater showing the movable ribs in the retracted position.
Figure 13:
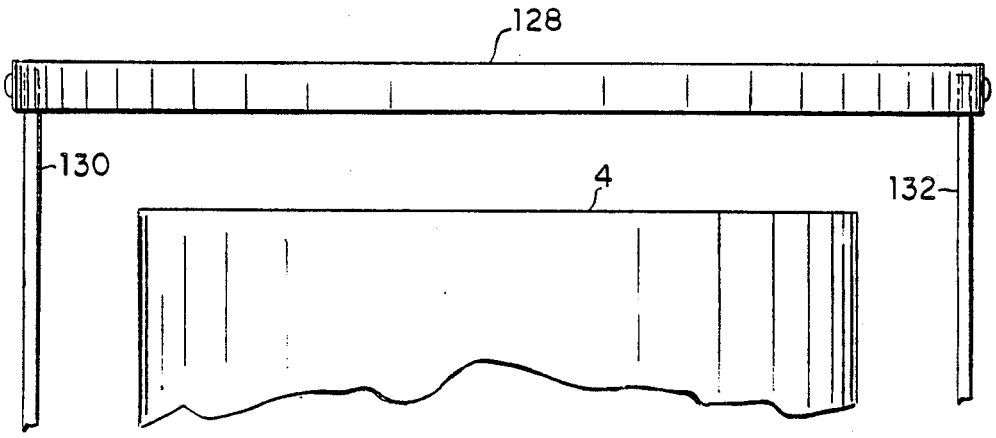
FIG. 13 is a fragmentary side elevation view of the heater of FIG. 12 rotated ninety degrees about its vertical axis and showing the movable ribs in the deployed position.

In another modification shown in FIG. 12 and 13, a canopy frame includes two movable ribs 126, 128, instead of one. Each rib has a first end portion pivotally supported on one frame leg 130 and a second end portion pivotally supported on the opposite leg 132. Pivotal support is achieved with rivets 134, 136, passing through a respective rib and into leg 130. Similar rivets attach the ribs to the opposite leg 132. Each rib is curved or Ushaped so that in a retracted position (solid line representation in FIG. 12) the U-shape appears upside-down and resembles the arcuate handle of the first embodiment. In fact, the ribs 126, 128, serve as a carrying handle when retracted.

The ribs pivot to a deployed position (broken line representation of FIG. 12 or solid line representation in FIG. 13) so that they can support the canopy (blanket). In the deployed position, the ribs are horizontal and together form a closed loop or ring which can be adjusted to a preferred height.

An advantage of this modification is that the canopy frame legs do not need to be inclined in order to remove the heat source from the heat guard 4. However, the ribs 126, 128 must be in the deployed position to clear the way.

Fourth Embodiment

Figure 14:
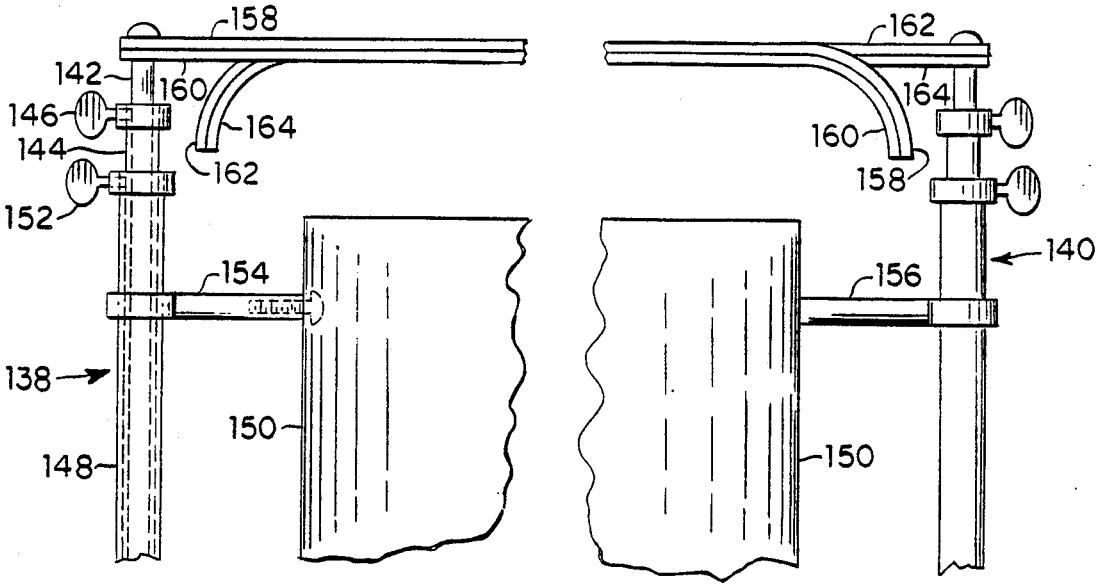
FIG. 14 is a fragmentary side elevation view of an upper portion of the fourth embodiment of the shielded heater showing the movable ribs in the retracted position.
Figure 15:
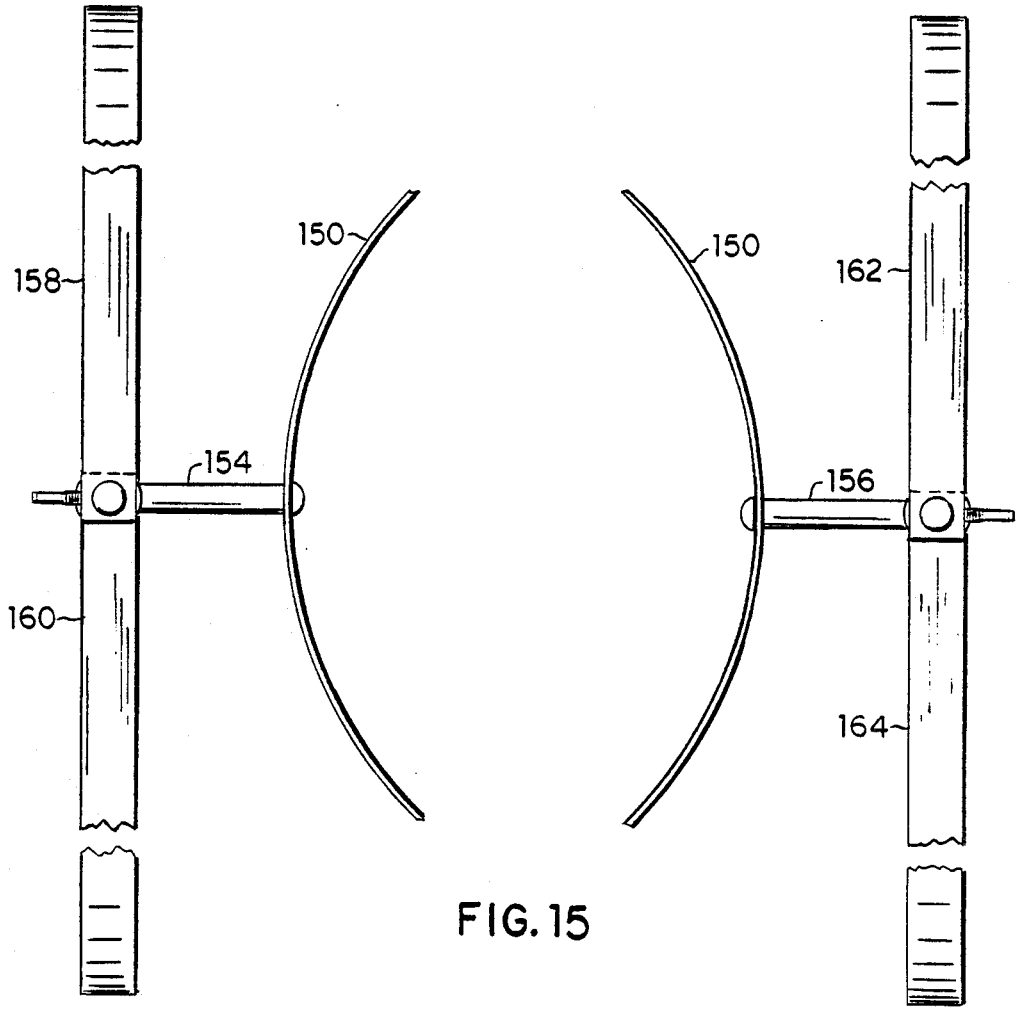
FIG. 15 is a fragmentary plan view of an upper portion of the heater of FIG. 14 showing the movable ribs in the deployed position.

Shown in FIG. 14 and 15 is a heater having a canopy frame with telescoping legs 138, 140. In leg 138, a rod 142 is slidably supported in a hollow intermediate shaft 144. The intermediate shaft includes a locking device 146 fixed to a top end portion of the shaft. The locking device is of the type comprising a collar and a thumbscrew mated to a threaded bore within the collar. By tightening the thumbscrew against the rod 142 the latter can be locked at a desired height. Shaft 144 is slidably supported in a hollow lower shaft 148 which is fixed to a heat guard 150. The bottom end of the lower shaft 148 is at the same level as the bottom end of the heat guard 150. Lower shaft 148 includes a locking device 152, similar to lock 146, fixed to an upper end portion. The lock 152 holds the intermediate shaft 144 at a desired height.

Leg 140 is a duplicate of leg 138. Each leg 138, 140 is spaced from the heat guard 150 and is fixed thereto by a bracket 154, 156, respectively.

Each telescoping leg serves to support a pair of pivotally mounted ribs 158, 160, 162, 164 so that there are a total of four ribs. The ribs are mounted on the tip of the rod portion of each leg so that they pivot in a horizontal plane. Each rib is movable between a retracted position (FIG. 14) thereby narrowing the frame and a deployed position (FIG. 15) thereby widening the frame. A distal end portion of each rib is downwardly curved to avoid catching in the blanket.

An advantage of this embodiment is that the canopy frame can be adjusted to a greater height relative to the other described embodiments.

Another advantage is that the lower shaft of each leg remains permanently juxtaposed along the entire length of the heat guard 150. This insures space for gaseous circulation alongside the heat guard when the operating heater is covered by a blanket.

Like the third embodiment, this frame does not have to be inclined in order to remove the heat source, but the ribs must be in the deployed position to clear the way.

The ribs in the retracted position can serve as a carrying handle.

While the above description contains many specificities, these should not be construed as limitations on the scope of the invention, but rather as exemplifications of preferred embodiments thereof. Those skilled in the art will envision other possible variations that are within its scope. Accordingly, the scope of the invention should be determined not by the embodiments illustrated, but by the appended claims and their legal equivalents.

What is claimed is:

1. A portable heater comprising:

a heat source;

a hollow exhaust guide connected in gaseous communication with the heat source, the guide having an outer end portion which includes an opening, the guide being positioned relative to the heat source for passing the guide through a tent wall opening such that the outer end portion is outside of the tent while the heat source is inside of the tent;

a weather flange having front and rear surfaces which at least partially surround the exhaust guide so that the flange surfaces can be positioned adjacent the wall opening to inhibit the passage of ambient air through the wall opening; and a bipod positioned adjacent the flange front surface for standing the bipod outside of the tent to support the exhaust guide and flange wherein the flange protects the wall opening against outside weather.

2. The portable heater as defined in claim 1, further comprising inner and outer shield cups, each cup having an aperture for receiving the guide and portion such that the cups surround the end of the guide.

3. The portable heater as defined in claim 1, further comprising holding means for holding the tent wall against the flange.

4. The portable heater as defined in claim 3, wherein the holding means comprises a plurality of clips positioned adjacent the exhaust guide and flange, each clip having a portion extending away from the guide axis the clips having resilient means for urging the clip portions toward the flange so that the tent wall can be held between the clip portions and the flange.

5. The portable heater as defined in claim 1, further comprising an air intake tube connected in gaseous communication between the heat source and the front surface side of the weather flange such that air from outside of the tent can pass through the tube to the heat source.

6. A heater kit comprising:

heat source support means for supporting a heat source;

an exhaust guide having means for detachably connecting the guide to the heat source support means for guiding exhaust gases from the heat source to the outside of a tent while the heat source is inside the tent; and a heat guard connected to the heat source support means for surrounding the heat source;

a canopy frame positioned above and spaced from the heat guard for allowing gaseous circulation between the heat guard and limp material which might cover the heater; and means for selectively positioning the canopy frame up and down relative to the heat source support means.

7. The heater kit as defined in claim 6, further comprising a bipod for being detachably connected to the exhaust guide to support the same wherein the bipod is positioned relative to the guide and heat source support means for standing the bipod outside of the tent while the heat source support means is inside the tent.

8. The heater kit as defined in Claim 6, further comprising means for selectively positioning the heat guard above the heat source support means to convert the guard into an oven for receiving food to be heated.

* * * * *